US008764323B2

(12) United States Patent
Keeton

(10) Patent No.: US 8,764,323 B2
(45) Date of Patent: Jul. 1, 2014

(54) HEAT-ACTIVATED LINERLESS LABEL

(75) Inventor: Mark E. Keeton, Kettering, OH (US)

(73) Assignee: NCR Corporation, Duluth, GA (US)

( * ) Notice: Subject to any disclaimer, the term of this patent is extended or adjusted under 35 U.S.C. 154(b) by 849 days.

(21) Appl. No.: 11/968,114

(22) Filed: Dec. 31, 2007

(65) Prior Publication Data

US 2009/0169282 A1 Jul. 2, 2009

(51) Int. Cl.
*B41J 2/315* (2006.01)

(52) U.S. Cl.
CPC ..... *B41J 2/315* (2013.01)
USPC ..... 400/120.01; 347/221

(58) Field of Classification Search
USPC ..... 400/120.01, 613; 347/221
See application file for complete search history.

(56) References Cited

U.S. PATENT DOCUMENTS

| | | | | |
|---|---|---|---|---|
| 4,680,080 | A * | 7/1987 | Instance | 156/357 |
| 5,043,314 | A * | 8/1991 | Suzuki et al. | 503/214 |
| 5,103,583 | A * | 4/1992 | VanErmen | 40/638 |
| 5,292,713 | A * | 3/1994 | Stenzel et al. | 503/226 |
| 5,686,159 | A * | 11/1997 | Langan | 428/40.1 |
| 5,733,615 | A * | 3/1998 | Rackovan et al. | 428/35.7 |
| 6,017,408 | A * | 1/2000 | Rogers et al. | 156/249 |
| 6,037,042 | A * | 3/2000 | Kato et al. | 428/195.1 |
| 6,230,968 | B1 * | 5/2001 | Varadarajan | 229/201 |
| 6,326,071 | B1 * | 12/2001 | Francoeur | 428/40.1 |
| 6,332,631 | B1 * | 12/2001 | Kirk | 283/81 |
| 6,388,692 | B1 * | 5/2002 | Iwata et al. | 347/212 |
| 6,501,495 | B1 * | 12/2002 | Ichikawa et al. | 347/171 |
| 6,613,410 | B1 * | 9/2003 | Sellars | 428/40.1 |
| 6,737,137 | B2 * | 5/2004 | Franko et al. | 428/40.1 |
| 6,941,689 | B1 * | 9/2005 | Seidl | 40/310 |
| 2002/0092607 | A1 * | 7/2002 | Hassenzahl et al. | 156/247 |
| 2002/0155951 | A1 * | 10/2002 | Shuku et al. | 503/200 |
| 2004/0045953 | A1 * | 3/2004 | Yoshida et al. | 219/486 |
| 2004/0081500 | A1 * | 4/2004 | Hoshino et al. | 400/120.01 |
| 2005/0050719 | A1 * | 3/2005 | Hassenzahl et al. | 29/623.4 |
| 2005/0100689 | A1 * | 5/2005 | He et al. | 428/32.79 |
| 2005/0208250 | A1 * | 9/2005 | Blank et al. | 428/40.1 |
| 2006/0035050 | A1 * | 2/2006 | Hassenzahl et al. | 428/40.1 |
| 2006/0046931 | A1 * | 3/2006 | Nakane et al. | 503/201 |
| 2006/0062623 | A1 * | 3/2006 | Kohira | 400/120.18 |
| 2006/0164503 | A1 * | 7/2006 | Sato et al. | 347/220 |
| 2006/0170755 | A1 * | 8/2006 | Sato et al. | 347/197 |
| 2007/0058029 | A1 * | 3/2007 | Takahashi | 347/218 |
| 2007/0213214 | A1 * | 9/2007 | Roth et al. | 503/226 |
| 2007/0234618 | A1 * | 10/2007 | Adams et al. | 40/638 |
| 2008/0190561 | A1 * | 8/2008 | Sanbongi et al. | 156/361 |
| 2009/0258116 | A1 * | 10/2009 | Peyton et al. | 426/87 |
| 2009/0277061 | A1 * | 11/2009 | Jain et al. | 40/633 |
| 2010/0104342 | A1 * | 4/2010 | Kohira | 399/407 |
| 2010/0120613 | A1 * | 5/2010 | Denton et al. | 503/201 |

FOREIGN PATENT DOCUMENTS

| | | | | |
|---|---|---|---|---|
| JP | 2001048139 | A * | 2/2001 | B65C 9/20 |
| JP | 2001088814 | A * | 4/2001 | B65C 9/25 |

* cited by examiner

*Primary Examiner* — David Banh
(74) *Attorney, Agent, or Firm* — Michael Chan

(57) ABSTRACT

A heat-activated linerless label comprises a heat-activated adhesive coating. Portions of the heat-activated adhesive coating are selectively activated by a thermal printer.

7 Claims, 16 Drawing Sheets

Fast Food Restaurant

100

202

Items:

| | |
|---|---|
| Hamburger | $2.90 |
| Large Fries | $0.99 |
| Small Milkshake | $0.99 |
| Total: | $4.88 |
| Cash: | $5.00 |
| Change: | $0.12 |

FIG. 2

HEAT-ACTIVATED LINERLESS LABEL

BACKGROUND

Labels are slips of material that can be affixed to objects temporarily or permanently by adhesive or other means. A typical label is used for providing information about an object to which it is attached. As common examples, labels may be used to communicate the price of an item, the ingredients included in a food product, the destination of a package, instructions, warnings about the dangers of using a consumer product, the name of a person wearing a label, and the like. While most labels include indicia in the form of text and/or graphics (symbols, logos, bar codes, and the like), labels may simply include indicia by exhibiting a color. For example, a green label could indicate that an item offered for a special sales price.

Conventional labels typically are formed from a substrate having a layer of wet, tacky adhesive coating one side and a nonstick liner overlying the adhesive layer to protect the adhesive layer from inadvertently adhering to objects prior to use. When a label is to be used, it is peeled away from the nonstick liner and adhered to an object. The nonstick liner is then discarded.

As labels are used in a range of different applications, they can be provided in a variety of forms, including rolls, sheets of die-cut stock, and individual stickers. In some cases, users may utilize multiple labels for a single type of application. For instance, catalog companies typically use mailing labels to identify to the postal service the destination of each catalog. Since the size and shape of each mailing label is identical, it is preferable to pre-cut the labels prior to packaging. In this manner, the labels can be printed, removed from the nonstick liner, and adhered to the catalog without the burden of cutting the label. In other cases, users need the labels to be sized differently for each use. For instance, offices use mailing labels and file labels, which differ in size according to the amount of space necessary for each individual use. To provide flexibility in size, the labels can be packaged in a continuous roll. Upon using a label, a user severs the label to supply a custom sized label for the current application.

BRIEF DESCRIPTION OF THE DRAWINGS

FIG. 2 is a view of a first surface of the linerless label of FIG. 1A, including printed text.

DETAILED DESCRIPTION

Figure 1A:
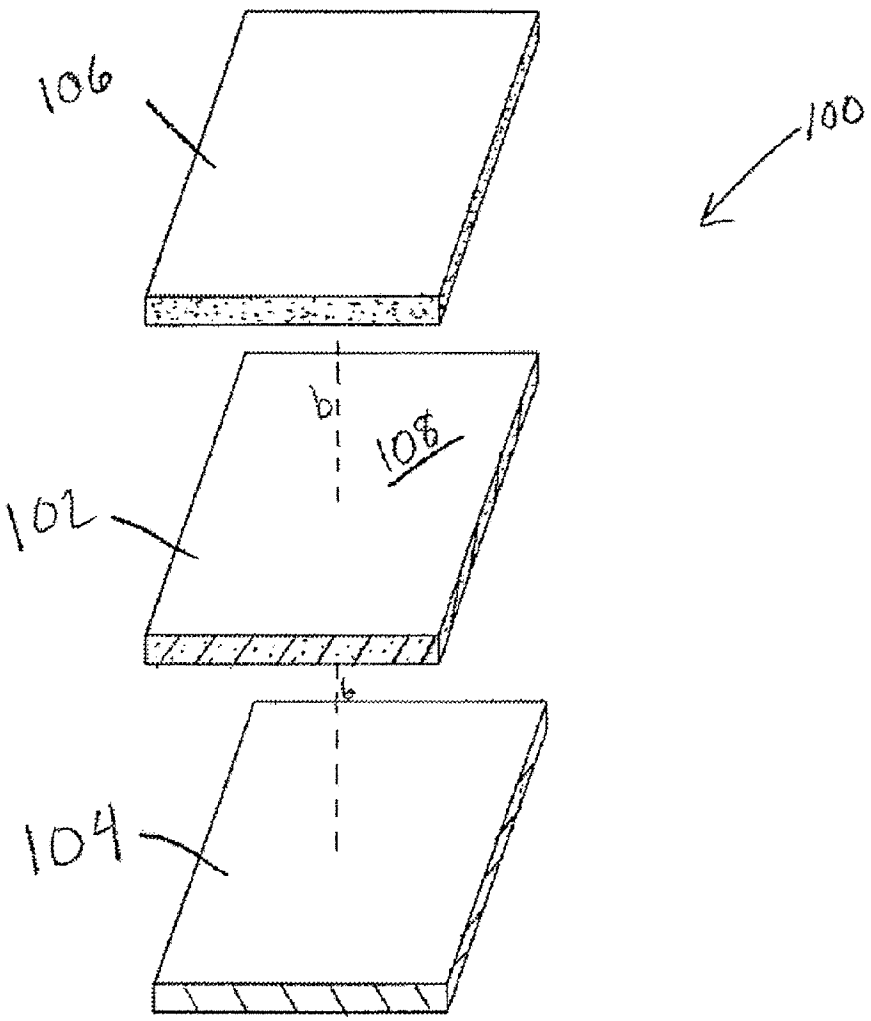
FIG. 1A is an exploded view of a linerless label according to an embodiment.

This disclosure presents various heat-activated linerless labels, methods of preparing and manipulating the labels, and systems for creating and manipulating the labels. A heat-activated linerless label is a slip of material that, prior to activation by heat, has two dry, non-tacky sides. Accordingly, during transport and storage, the label remains dry and non-tacky. Upon activation by heat, however, selected portions of the label become tacky and ready for adhesion. Since the label remains dry and non-tacky prior to activation, the label will not adhere to objects prior to activating the adhesive coating. Therefore, the label does not require a nonstick liner during transport and storage.

Eliminating nonstick liners reduces the thickness of the media entering the printer and eliminates costs associated with providing liner material. Moreover, the labels can be provided in a roll that can be unrolled easily, without the roll sticking to itself. Since the exclusion of the liner decreases the thickness in a roll of labels, more labels can be provided per roll without altering the size of the roll.

In accordance with various disclosed embodiments, a thermal printer can print visible images and/or activate selected adhesive portions on the heat-activated linerless label as the label passes through the thermal printer. The thermal printer can perform this printing and activation by selectively heating targeted portions of the label using one or more thermal print heads. Thermal print heads can be programmed to heat only specific portions of a heat-activated linerless label, and therefore thermal print heads can selectively activate adhesive portions of the label in any desired shape or pattern. In some embodiments, the thermal printer is a two-sided thermal printer capable of simultaneously or sequentially printing and/or activating adhesive on one or both sides of a heat-activated linerless label.

Thermal Printer Systems

Two, or dual-sided thermal printing comprises the simultaneous or substantially simultaneous printing or imaging of a first side and a second side of print media through selective application of heat by one or more thermal print heads. Common forms of two-sided thermal printing include two-sided direct thermal printing and two-sided thermal transfer printing. Each of these types of two-sided thermal printing are discussed briefly below.

Examples of two-sided direct thermal printing are described in U.S. Pat. Nos. 6,784,906 and 6,759,366, assigned to NCR, the assignee of the instant application, the disclosures of which are hereby incorporated by reference. In two-sided direct thermal printing, a two-sided direct thermal printer is configured to allow concurrent printing on both sides of suitable two-sided media moving along a media feed path through the printer. In such printers a thermal print head is disposed on each of two sides of the media for selectively applying heat to one or more thermally sensitive coatings thereon. The coatings change color when heat is applied, by which direct thermal printing is provided on the respective sides.

Examples of two-sided thermal transfer printing are described in U.S. patent applications Ser. Nos. 11/779,732, 11/780,959, 11/834,411 and 11/835,013, assigned to NCR, the assignee of the instant application, the respective disclosures of which are hereby incorporated by reference. In two-sided thermal transfer printing, a two-sided thermal transfer printer is configured to allow concurrent thermal transfer printing on both sides of suitable two-sided media moving along a media feed path through the printer. In such printers, thermal print heads are disposed on respective opposite sides of the media for selectively applying heat to one or more thermal transfer ribbons situated between a respective thermal print head and media side by which thermal transfer printing is provided thereon.

In addition to two-sided thermal transfer, and two-sided direct thermal printers, another type of two-sided thermal transfer printer is a hybrid two-sided direct thermal and thermal transfer printer. The hybrid two-sided direct thermal and thermal transfer printer uses direct thermal printing to print on one side of a label and thermal transfer printing to print on the other side of the label.

Figure 15:
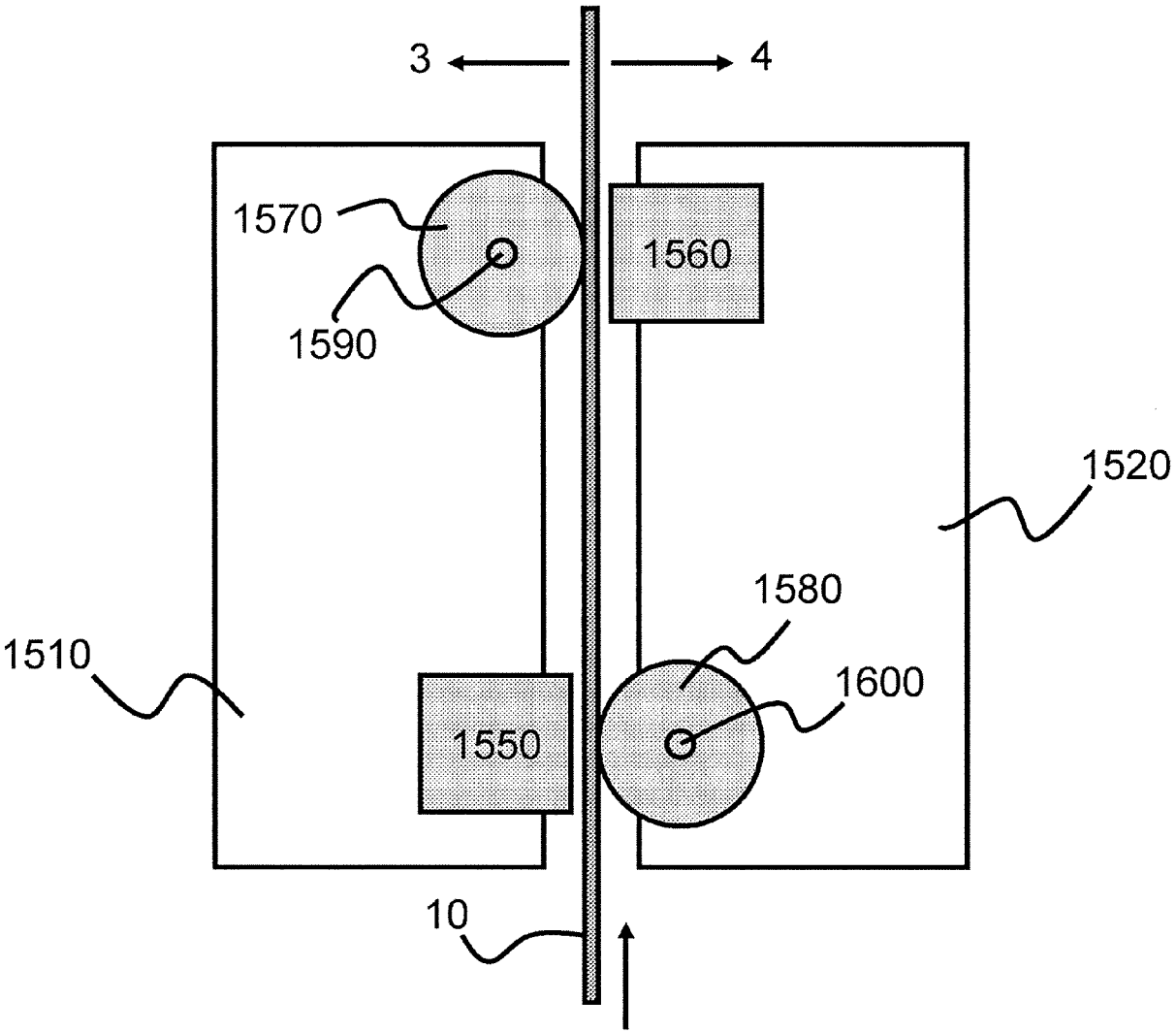
FIG. 15 illustrates a basic two-sided thermal printer that could be used in some embodiments.

FIG. 15 illustrates a basic two-sided thermal printer that could be used in selected embodiments of the invention. The two-sided thermal printer is provided as a simple teaching example, and should not be interpreted to limit the scope of the invention.

Referring to FIG. 15, the two-sided thermal printer comprises a first print head assembly 1510, a second print head assembly 1520, and a motor (not shown). The first print head assembly 1510 comprises a first print head 1550 and a first platen 1570 rotatable about a first shaft 1590. Similarly, the second print assembly 1520 comprises a second print head 1560 and a second platen 1580 rotatable about a second shaft 1600.

During operation of the two-sided thermal printer, the motor drives the first and second shafts 1590 and 1600 to turn the first and second platens 1570 and 1580. Accordingly, when a label 10 is fed into the printer, rotation of the first and second platens 1570 and 1580 pushes the label 10 in a direction indicated by a vertical arrow. As the label 10 passes through the printer, the first and second print heads 1550 and 1560 selectively heat the two sides of label 10 to perform printing operations. More particularly, first print head 1550 performs printing operations on a side of label 10 indicated by an arrow 3 and second print head 1560 performs printing operations a side of label 10 indicated by an arrow 4.

For simplicity of illustration, various details have been omitted from the description of the basic two-sided thermal printer illustrated in FIG. 15. Additionally, various modifications could be made to the printer without changing its basic function. Nevertheless, the description of the printer provides context for understanding some embodiments of the invention.

Linerless Label

Figure 3:
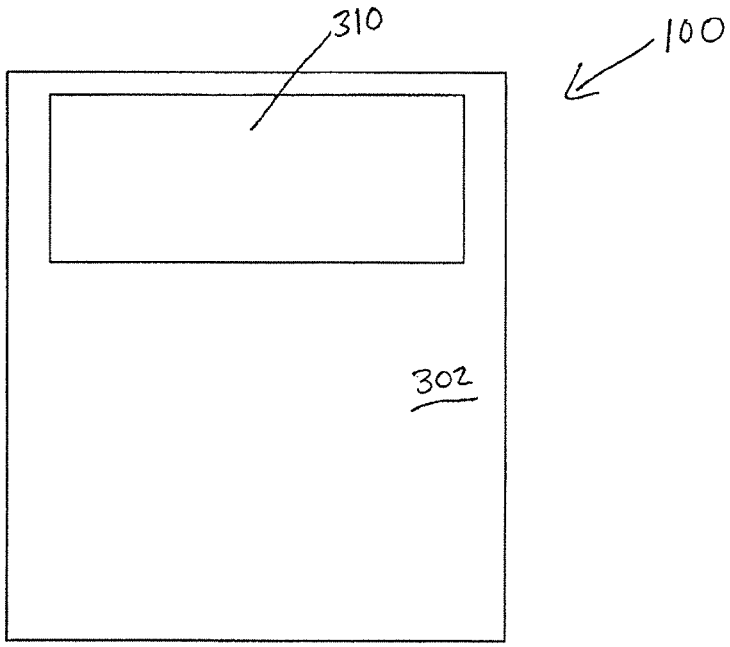
FIG. 3 is a view of a second surface of the linerless label of FIG. 1A, including a strip of activated adhesive.

FIGS. 1-3 illustrate a linerless label 100 that includes a printable surface including imaging material on one side and a heat-activated adhesive surface on the other side. In some embodiments, substrates may be thermally resistant in order to prevent heat applied to one side of the substrate from activating materials on the other side of the substrate.

Figure 1B:
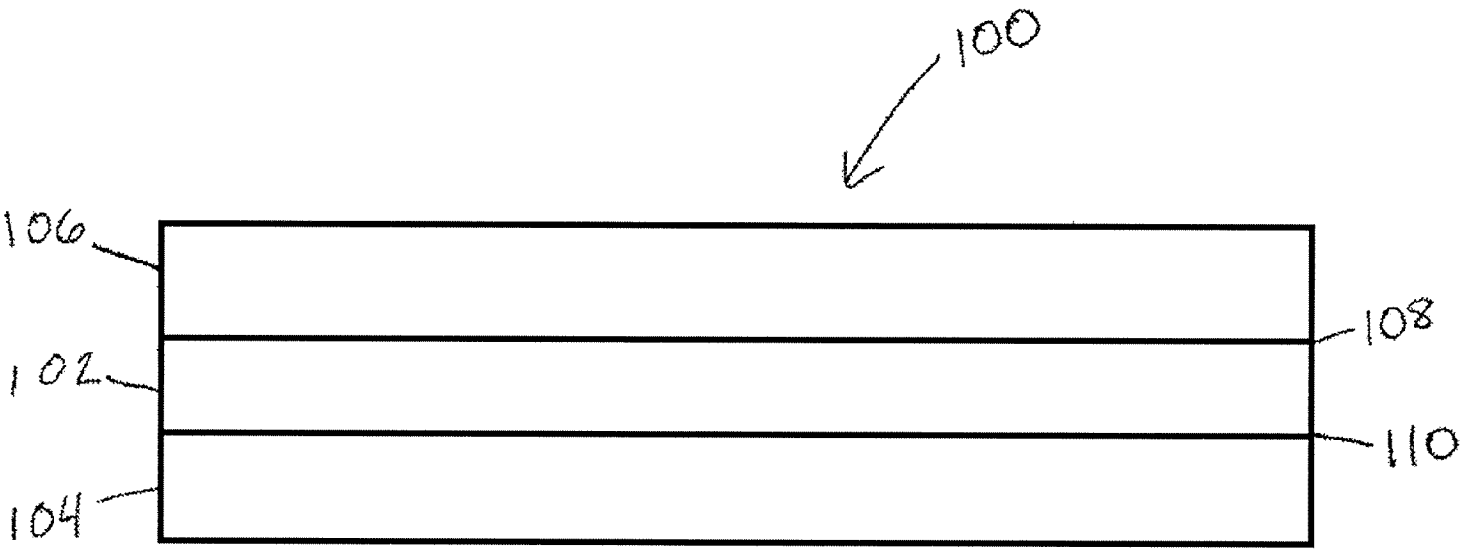
FIG. 1B is a cross-sectional view of the linerless label of FIG. 1A.

FIG. 1A shows an exploded view of the linerless label 100, which is formed of layers including a substrate 102, a print layer 104, and a heat-activated adhesive layer 106. The layers are aligned along a dotted line "b" and laminated to one another. FIG. 1B provides a cross-sectional view of the linerless label 100. As illustrated in FIGS. 1A and 1B, the adhesive layer 106 overlies a first surface 108 of the substrate 102 and the print layer 104 overlies a second surface 110 of the substrate 102. The print layer 104 can include one or more layers of thermal imaging material. For instance, the print layer 104 can include a thermal transfer receptive coating suitable for thermal transfer printing. Alternately or additionally, the print layer 104 may include one or more thermally sensitive coatings which are adapted to change color upon application of heat thereto by which direct thermal printing is provided. Examples of various print layers are described in detail below with respect to FIGS. 7-9.

As an alternative to using a separate print layer, the respective substrates in various examples of this disclosure could comprise thermochromic paper. A thermal print head can print visible patterns on thermochromic paper without requiring an additional print layer to be formed on the substrate.

FIG. 2 illustrates an example of a first surface 202 of the linerless label 100 after printing. In this example, the label 100 is a receipt for a fast food meal. As shown in FIG. 2, the first surface 202 of the linerless label 100 has been printed with transaction information by, for example, direct thermal printing of one or more thermally sensitive compounds in the print layer 104.

FIG. 3 illustrates a second surface 302 of the label 100. The second surface 302 includes a wet adhesive portion in the form of a tacky strip 310 of heat-activated adhesive material that has been activated by, for example, a thermal print head of a two-sided thermal printer such as print head 1550 or 1560 illustrated in FIG. 15. In this example, the tacky strip 310 can be used to attach the receipt to an associated bag of food. Consequently, the bag and the receipt can be handed to a customer simultaneously.

The tacky strip 310 can be formed in one of at least two different manners. In the first manner, the entire second surface 108 of the substrate 102 can be overlaid by a heat-activated adhesive that is dry and non-tacky prior to activation. Then, only a selected portion of the heat-activated adhesive, the portion defining the strip 310, is activated by heat applied with a thermal print head such as print head 1550 or 1560. Depending on the embodiment, such activation may occur at or substantially at the same time as, or at some time after the first surface 202 of the receipt has been printed with transaction information. In the second manner, a portion of the second surface 108 defining the strip 310 can be overlaid with a heat-activated adhesive that is dry and non-tacky prior to use. The entire heat-activated adhesive can be activated by a thermal print head, which activation may, depending on the embodiment, occur at or substantially at the same time as, or at some time after the first surface 202 of the receipt has been printed with transaction information. Either manner will result in a tacky adhesive strip 310. A first thermal print head such as print head 1550 of a double-sided thermal printer can print on the first surface 202 of the receipt while a second thermal print head such as print head 1560 activates the second surface 302 of the receipt.

Figure 4:
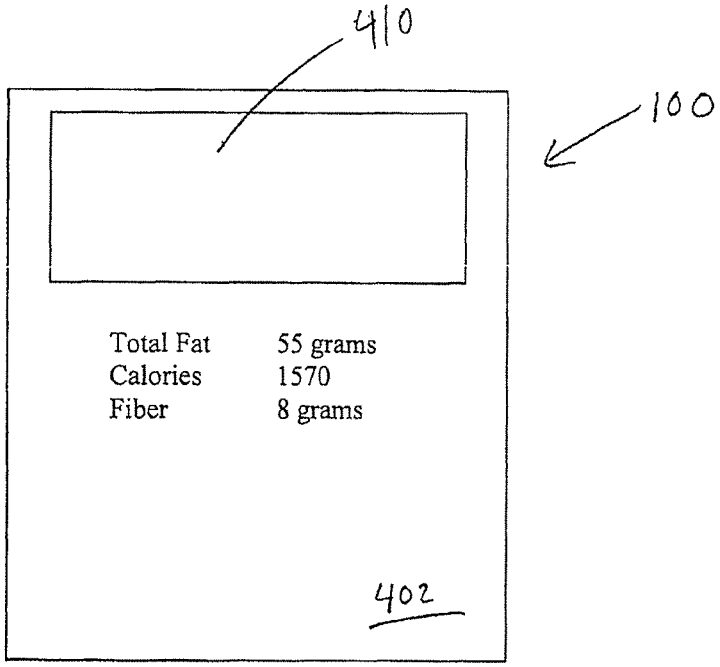
FIG. 4 is a view of an alternative second surface of the linerless label of FIG. 1A, including a strip of activated adhesive and printed text.

FIG. 4 provides an alternative second surface 402 of the linerless label 100 of FIGS. 1-3. In this example, the second surface 402 of the receipt includes nutritional information and a strip 410 of activated adhesive material. The illustrated second surface 402 can be formed by covering a portion of the first surface 108 of the substrate 102 with a print layer and covering some or all of the remaining portion of the first surface 108 of the substrate 102 with a heat-activated adhesive that is dry and non-tacky prior to activation. Then some or all of the print layer covered portion and/or the heat-activated adhesive covered portion can be activated by a thermal print head of an associated thermal printer such as that illustrated in FIG. 15. This printing and/or activation may, depending on the embodiment, occur at or substantially at the same time as, or at some time after the first surface 202 of the receipt has been printed.

Another manner of forming the illustrated second surface 402 of FIG. 4 is by covering the entire first surface 108 of the substrate 102 with a print layer and a portion of the first surface 108 with a heat-activated adhesive. When the print layer and the heat-activated adhesive are arranged in this manner, a thermal print head of an associated thermal printer such as that illustrated in FIG. 15 may be operated to activate some or all of the heat-activated adhesive portion to, for example, form the strip 410, and to image some or all of the print layer to, for example, print text in the form of nutritional information. In still another embodiment, the entire first surface 108 of the substrate 102 may be covered with a print layer and a heat activated adhesive. When the print layer and the heat-activated adhesive are arranged in this manner, a thermal print head of an associated thermal printer can be operated to activate a portion of the heat-activated adhesive to form the strip 410 and to print desired text, such as the above described nutritional information, on the print layer.

Regardless of the coating configuration, selective imaging of a print layer and/or activation of a heat activated adhesive may be provided for through control of the imaging and/or activation temperatures of the respective print and adhesive layer components. For example, in one embodiment, some or all of a first surface 108 of a substrate 102 may be coated with a print layer containing one or more thermally sensitive materials which materials are selected to image at a first temperature, T1. Likewise, some of all of the first surface 108 of the substrate 102 may be coated with a heat activated adhesive which activates at a second temperature T2, different from T1.

In one embodiment, the thermally sensitive materials in the print layer may image at a first temperature, T1, that is less than the second temperature, T2, at which the heat activated adhesive activates. For example, the thermally sensitive materials may be selected to image at a first temperature, T1, in a range of 100 to 150° C., while the heat activated adhesive may be selected to activate at a second temperature, T2, in a range of 150 to 200° C. In this embodiment, a thermal print head associated with a thermal printer such as that illustrated in FIG. 15 may be adapted to apply heat at the first temperature T1 (e.g., 120° C.), to image portions of the print layer without activating any of the heat activated adhesive. This thermal print head may be further adapted to apply heat at the second temperature T2 (e.g., 160° C.) to activate portions of the heat activated adhesive, whether or not the portions of the heat activated adhesive are proximate any thermally sensitive material. When operated at the second temperature T2, the thermal print head may simultaneously image portions of the print layer proximate to (e.g., below) the heat activated adhesive.

In an alternate embodiment, the thermally sensitive materials in the print layer may image at a first temperature T1 that is greater than a second temperature T2, at which the heat activated adhesive activates. For example, the thermally sensitive materials may be selected to image at a first temperature T1 in a range of 150 to 200° C., while the heat activated adhesive may be selected to activate at a second temperature T2 in a range of 100 to 150° C. In this embodiment, a thermal print head associated with a thermal printer such as that illustrated in FIG. 15 may be adapted to apply heat at second temperature T2 (e.g., 130° C.) to activate select portions of the heat activated adhesive without imaging of any proximate (e.g., below) thermally sensitive material. Likewise, the thermal print head may be further adapted to apply heat at a first temperature T1 (e.g., 170° C.) to image portions of the thermally sensitive materials, whether or not proximate to (e.g., below) any heat activate adhesive. When operated at the first temperature, T1, the thermal print head may, however, simultaneously activate portions of the heat activated adhesive proximate to (e.g., on-top of) the thermally sensitive material. Such configuration may find use in, for example, printing of window stickers wherein the adhesive portions comprise the imaged (i.e., printed) portions.

One or more sense marks (not shown) may be provided where only a portion of a surface 108 of a substrate 102 associated with a heat activated label 100 is covered with a print layer and/or a heat activated adhesive to permit such portions to be properly registered in a printer and/or properly identified for printing and/or activation.

A method similar to the methods used to make the labels of FIGS. 2-4 can be used to create sticky or repositionable notes. A sticky or repositionable note is slip of material having a re-adherable strip or region of adhesive on a surface. Accordingly, a sticky or repositionable note can be created by activating a strip or region of heat activated adhesive such that it creates a low tack adhesive coating on a first side of a substrate.

A repositionable note typically is used to temporarily attach notes to a surface. For instance, in an office setting, a repositionable note can be attached to the outer surface of the file to provide information for a limited amount of time. The repositionable note can be printed on, since the adhesive coating is activated at the same time or after the second side of the substrate is printed on. A printed message on the repositionable note may be clearer and, in some cases, shorter than handwritten notes. Another possibility for creating repositionable notes is to activate a strip of low tack adhesive without printing. Then, when the repositionable note is released from the printer, the user can hand write a message on the note. This option provides a way to make repositionable notes in custom sizes.

Figure 12:
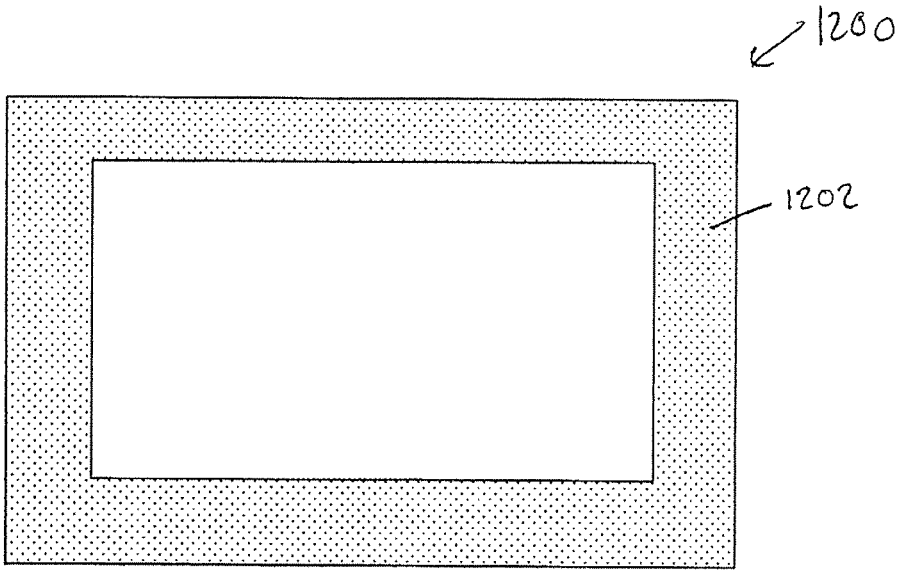
FIG. 12 is a view of a surface of a linerless label according to an embodiment.

Regardless of the use, a repositionable note may be created with customizable adhesive/tackiness of adhesive regions through, for example, control of the type of adhesive (e.g., high/low tack), control of the size and/or shape of the adhesive region (e.g., long thin, short fat, block, rectangle, star, border, and the like), and/or control of the amount of adhesive activated within a given region (e.g., stippled activation) as described hereinbelow with regard to, for example, FIG. 12.

Figure 5:
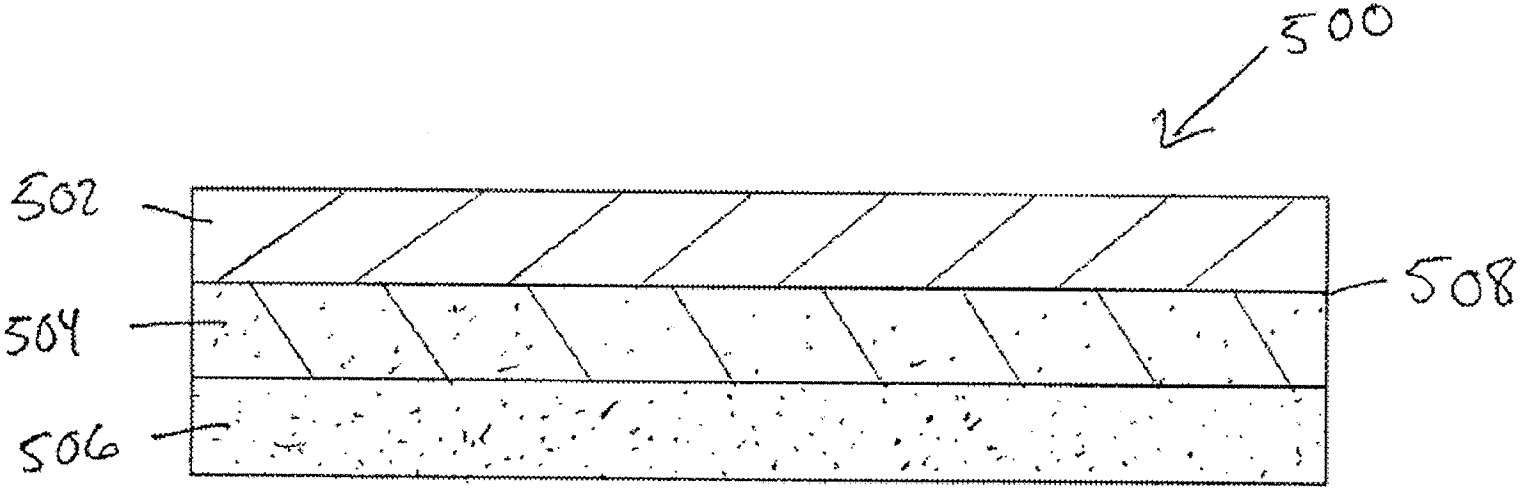
FIG. 5 is a cross-sectional view of a linerless label according to an embodiment.
Figure 6:
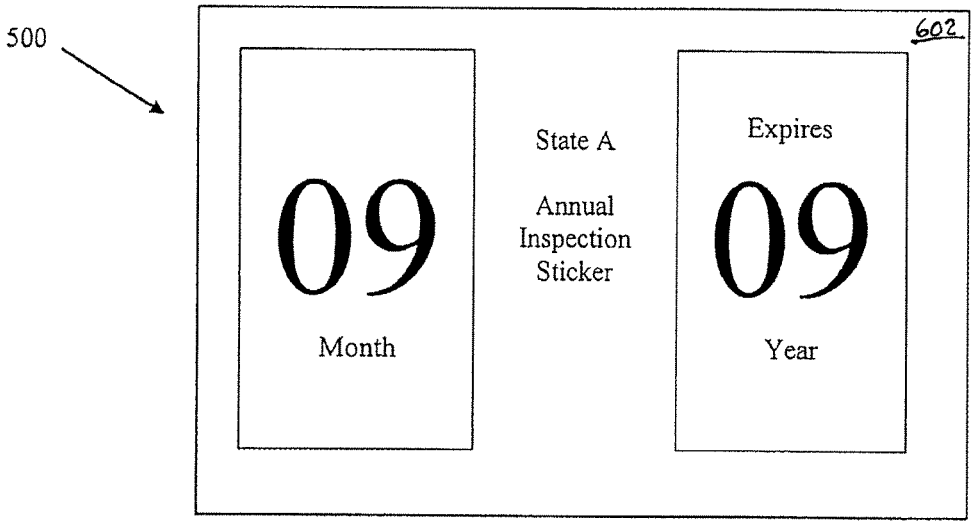
FIG. 6 is a view of a first surface of the linerless label of FIG. 5.

FIGS. 5 and 6 illustrate a linerless label 500 including imaging material and a heat-activated adhesive on one side thereof. FIG. 5 shows a cross-sectional view of the linerless label 500, which includes a substrate 502, a print layer 504, and a heat-activated adhesive layer 506. Both the adhesive layer 506 and the print layer 504 overlay a first surface 508 of the substrate 502. The print layer 504 can include one or more layers of thermal imaging materials. For instance, the print layer 504 can include a thermally sensitive coating for direct thermal printing. Detailed examples of print layers are described in detail below with respect to FIGS. 7-9.

FIG. 6 illustrates an example of a first surface 602 of the linerless label 500 after being printed on. In this example, the label 500 is a state automobile inspection sticker. As shown in FIG. 6, the first surface 602 has been printed with inspection information. The adhesive layer 506 on the first surface 602 can be activated to become tacky while the inspection information is printed. Alternatively, the adhesive layer 506 can be activated to become tacky after the inspection information is printed. When the first surface 506 is activated to become tacky, the inspection sticker can be adhered to the inside of a windshield. Consequently, the inspection information will be visible from outside the windshield. The print layer 504 and heat activated adhesive layer 506 may, depending on the embodiment, be selected to activate at the same or different temperatures as described hereinabove.

Figure 7:
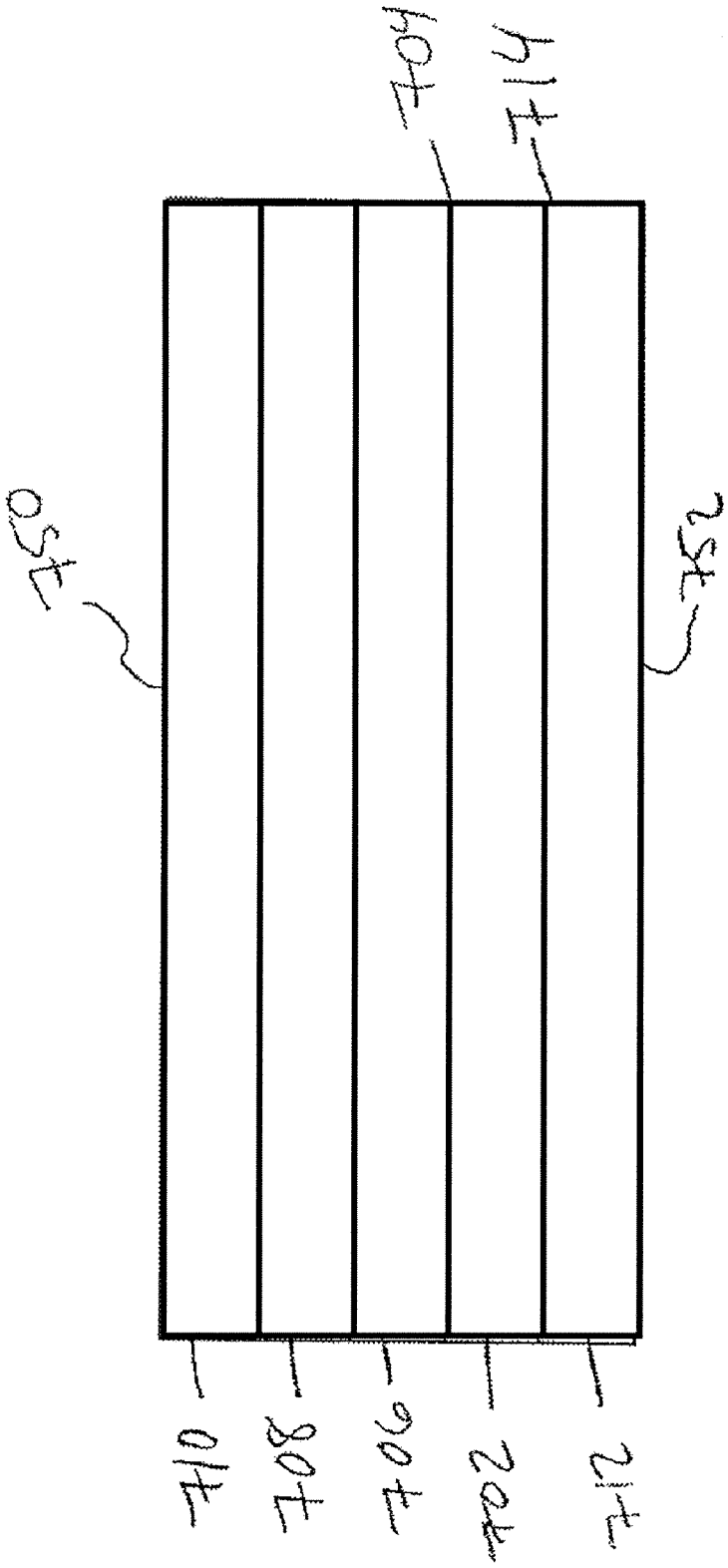
FIG. 7 is a cross-sectional view of a linerless label according to an embodiment.

FIG. 7 illustrates an example of a heat-activated linerless label 700 that can be printed on and activated by a two-sided direct thermal printer. The label 700 comprises a substrate 702, a sub coat 706 formed on a first surface 704 of the substrate 702, a thermally sensitive coating 708 formed on the sub coat 706, and a top coat 710 formed on the thermally sensitive coating. The label 700 further comprises a heat-activated adhesive 712 formed on a second surface 714 of substrate 702. Label 700 has a first surface 750 on top coat 710 and a second surface 752 on heat-activated adhesive 712. When fed through a two-sided direct thermal printer, a first thermal print head such as print head 1550 can image the thermally sensitive coating 702 by applying heat to the first surface 750 and a second thermal print head such as print head 1560 can activate the heat-activated adhesive 712 by applying heat to the second surface 752.

In alternate embodiments, one or both of a heat activated adhesive 712 and a thermally sensitive coating 702 may be provided on or proximate to (e.g., on top of one or more sub coats 706) one or both sides 704, 714 of a substrate 702. Further, where applied, the respective adhesive and thermally sensitive coatings 712 and 708 may cover some or all of the surface area of a give substrate side 714 or 704 (e.g., be provided in full, spot, stripe, region, pattern, and/or like coverage). Such configurations allows the first surface 750 and/or the second surface 752 of the label 700 to be selectively printed and/or activated by, for example, a respective first and/or second thermal print head of a two-sided thermal printer such as that illustrated in FIG. 15.

The thermally sensitive coating 708 can include at least one dye and/or pigment, and can include one or more activating agents which undergo a color change upon the application of heat. In one embodiment, the thermally sensitive coating 708 includes a dye-developing type thermally sensitive coating comprising one or more leuco-dyes, developers, and, optionally, one or more sensitizers such as those described in U.S. Pat. No. 5,883,043, the disclosure of which is hereby incorporated by reference.

The sub coat 706 can be formed as an isolation layer between the first surface 704 and the thermally sensitive coating 708 to avoid adverse interaction of chemicals and/or impurities from the substrate 702 with the thermally sensitive coating 708. Additionally, the sub coat 706 may be formed to prepare the first surface 704 for reception of the thermally sensitive coating 708. For instance, the sub coat 706 can provide a particular surface finish or smoothness. Suitable sub coats can include clay and/or calcium carbonate based coatings. In one embodiment, a clay based sub coat is formed on the second surface of a spunbonded high density polyethylene substrate, and calendared to a smoothness of greater than approximately 300 Bekk seconds prior to application of an associated thermally sensitive coatings comprising one or more leuco dyes, developers and sensitizers.

The top coat 710 can be formed over the thermally sensitive coating 708 to protect the thermally sensitive coatings 708 and/or any resultant image from mechanical (e.g., scratch, smudge, smear, and the like) and/or environmental (e.g., chemical, UV, and the like) degradation. Additionally, the top coat 710 may be provided to enhance the movement of printing components along first surface 704. The top coat 710 may include any suitable components that can serve to protect or enhance the performance and/or properties of a thermally sensitive coating 708, such as one or more polymers, monomers, UV absorbers, scratch inhibitors, smear inhibitors, slip agents, and the like. In one embodiment, the top coat 710 comprises varnish.

In the event that both sides 704 and 714 of the substrate 702 are covered with thermally sensitive coating 708 and/or a heat activated adhesive 712, the thermally sensitive coating and/or heat activated adhesive on one (e.g., a first) side may respectively image and/or activate at a different (e.g., lower) temperature than the thermally sensitive coating and/or heat activated adhesive on the other (e.g., a second) side to prevent heat applied to the first side to image and/or activate the respective thermally sensitive coating and/or heat activated adhesive thereon from imaging and/or activating the respective thermally sensitive coating and/or heat activated adhesive on the second side. Alternatively or additionally, the substrate 702 may have sufficient thermal resistance to prevent heat applied to one side from imaging and/or activating the respective thermally sensitive coating and/or heat activated adhesive on the other side. Variations, including combinations of varied temperature imaging and/or activation within a given side and/or among a first and a second side, and sufficiently thermally resistant substrates are also possible.

Figure 8:
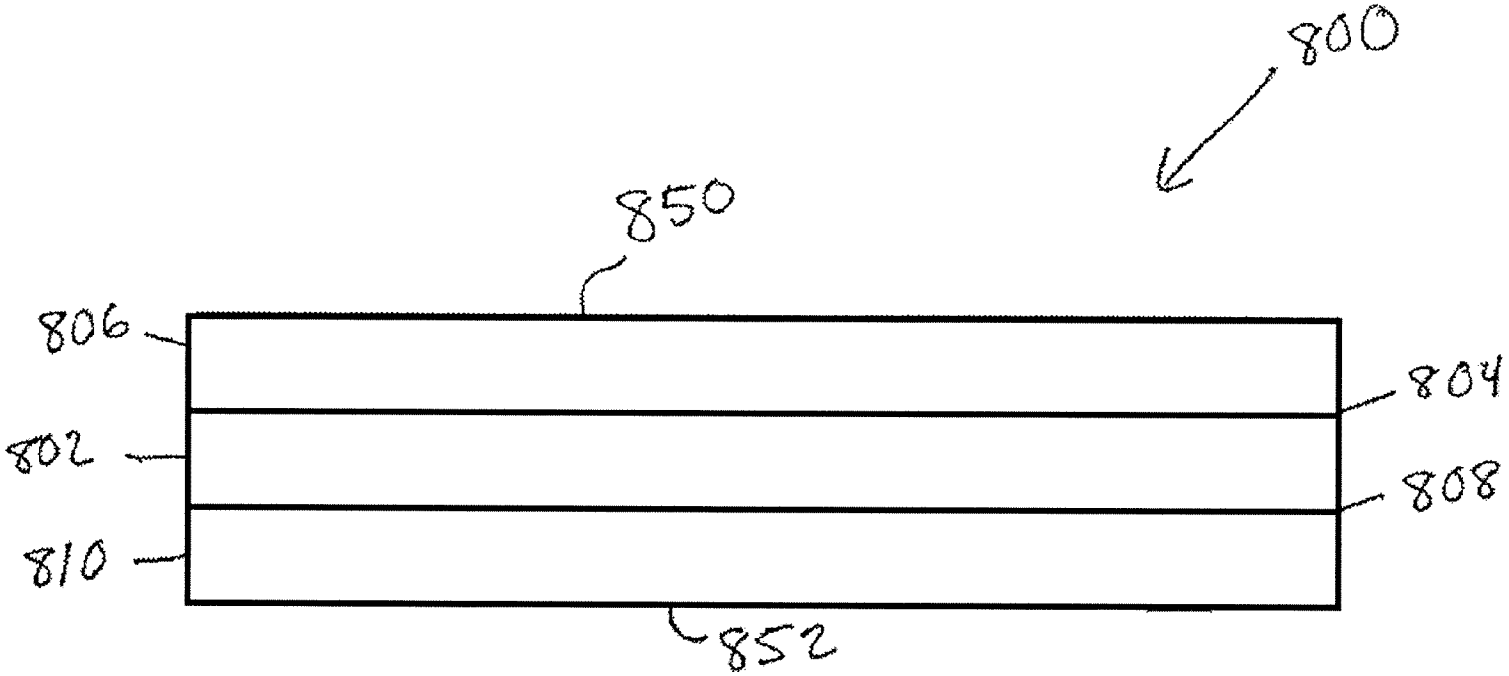
FIG. 8 is a cross-sectional view of a linerless label according to an embodiment.

FIG. 8 illustrates an example heat-activated linerless label 800 that can be used with, inter alia, a two-sided thermal transfer printer. The label 800 comprises a substrate 802, an adhesive layer 806 formed on a first surface 804 of substrate 802, and a thermal transfer receptive coating 810 formed on a second surface 808 of substrate 802. The label 800 includes a first surface 850 on adhesive layer 806 and a second surface 852 on thermal transfer receptive coating 810.

The thermal transfer receptive coating 810 can comprise one or more materials for preparing the second surface 808 to accept transfer of a functional coating (dye and/or pigment bearing substance) from a thermal transfer ribbon of a thermal transfer printer. Suitable thermal transfer receptive coatings may comprise a clay (e.g., kaolinite, montmorillonite, illite, and chlorite), resin (e.g., urethane, acrylic, polyester, and the like), or a combination thereof, with or without a binder (e.g., polyvinyl acetate (PVA)). The thermal transfer coatings may further be prepared to a desired or required surface finish and/or smoothness post-application. In one embodiment, the thermal transfer receptive coating can comprise 90% clay and 10% PVA (as-dried) calendared to a smoothness of greater than approximately 300 Bekk seconds.

According to various embodiments, one or both of the first surface 850 and the second surface 852 of the label 800 can include both a heat-activated adhesive and a thermal imaging material such as a thermal transfer receptive coating. This configuration allows either the first surface 850 or the second surface 852 of the label 800 to be selectively printed and/or activated by a thermal print head such as print head 1550 or 1560 illustrated in FIG. 15.

Figure 9:
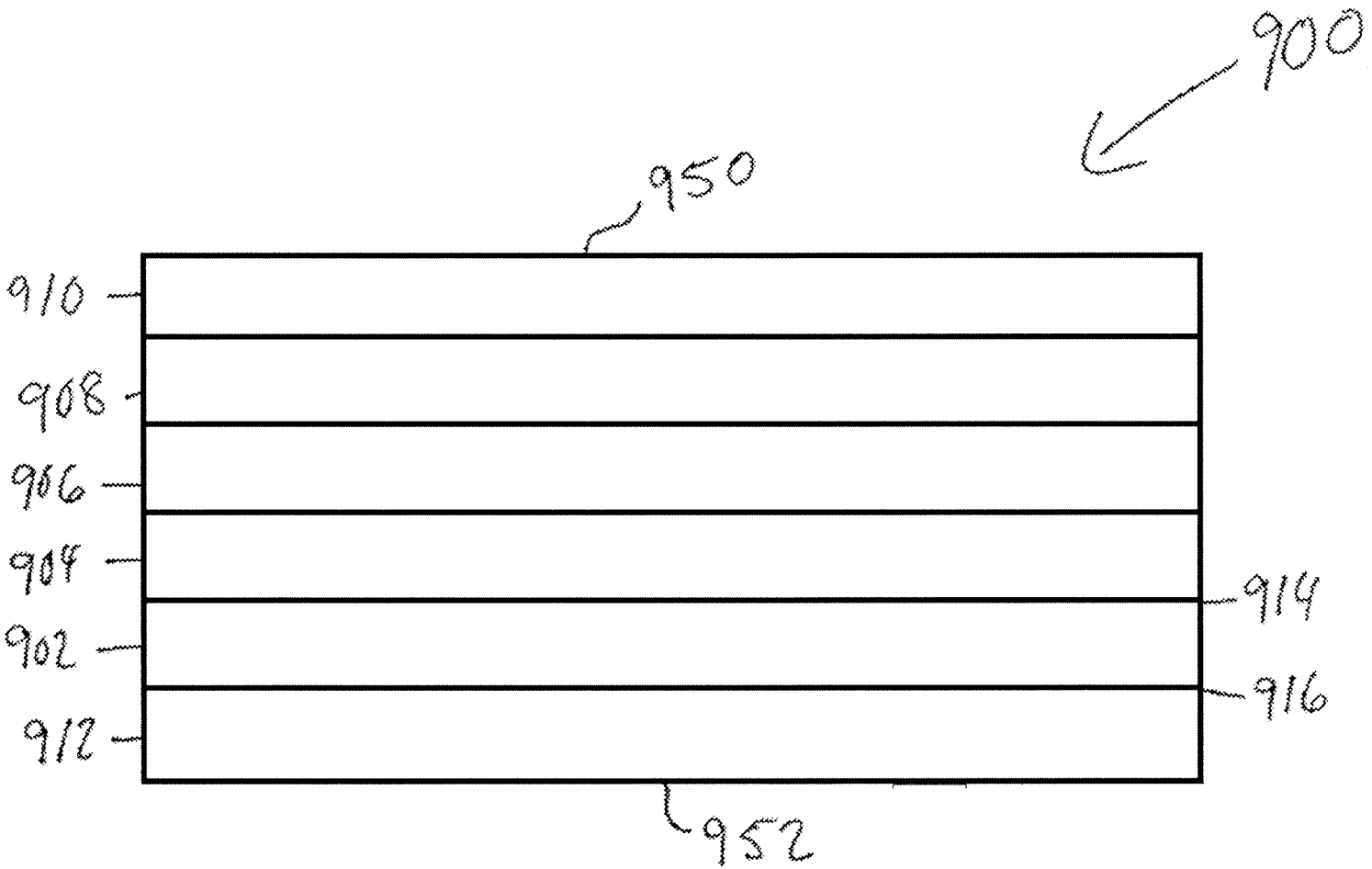
FIG. 9 is a cross-sectional view of a linerless label according to an embodiment.

FIG. 9 illustrates an example heat-activated linerless label 900 that can be used with a two-sided thermal printer comprising both direct thermal print means comprising a direct thermal print head and thermal transfer print means comprising a thermal transfer print head. As an example, this two-sided thermal printer could have a configuration like the two-sided thermal printer shown in FIG. 15. The direct thermal print means is used to print (i.e., image) a thermally sensitive coating of the heat-activated label 900 and the thermal transfer print means and an associated thermal transfer ribbon are used to print (i.e., deposit one or more functional coatings) on a thermal transfer receptive coating of the label 900.

Referring to FIG. 9, the label 900 comprises a substrate 902, a sub coat 904 formed on a first surface 914 of substrate 902, a thermally sensitive coating 906 formed on sub coat 904, a top coat 908 formed on thermally sensitive coating 906, and an adhesive layer 910 formed on top coat 908. The label 900 further comprises a thermal transfer receptive coating 912 formed on a second surface 916 of substrate 902. Additionally, the label 900 has a first surface 950 on adhesive layer 910 and a second surface 952 on thermal transfer receptive coating 912. Because the thermally sensitive coating 906 and the adhesive layer 910 are both formed on the first 914 of substrate 902, label 900 can be printed on and the adhesive activated by applying first surface 950 using one or more thermal print heads.

As discussed above, a thermally sensitive coating may be selected to image at a temperature, T1, different from a temperature, T2, at which a proximate heat activated adhesive activates. As such, a thermal print head of a thermal printer can be advantageously operated at different temperatures to selectively image and/or activate the respective thermally sensitive coating and/or heat activated adhesive. As an example, a direct thermal print head may apply heat to the first surface 950 at a first temperature, T1, to selectively image a thermally sensitive coating 906 without activating a proximate adhesive layer 910. Likewise, the thermal print head may apply heat to the first surface 950 at a second, higher temperature, T2, to activate adhesive layer 910. In such case, the thermally sensitive coating 906 will also likely image proximate to where the heat activated adhesive activates as the second temperature, T2, at which the heat activated adhesive activates is higher than the first temperature, T1, at which the thermally sensitive coating images. Accordingly, in some instances, heat generated by the direct thermal print head can both print on the first surface 950 and activate the adhesive layer 910. Variations, including embodiments where the heat activated adhesive activates at a temperature lower than the temperature at which the thermally sensitive coating images are also possible.

According to various embodiments, the second surface 952 of the label 900 can additionally include a heat-activated adhesive. This configuration allows either the first surface 950 or the second surface 952 of the label 900 to be selectively printed and/or activated by a thermal print head.

Although FIGS. 7-9 illustrate various layers of thermal imaging materials, other types of printable coatings can also be included in the illustrated labels. For instance, one or more of the illustrated labels could be modified to include a layer of silica or calcium carbonate on the dry, printing surface to enhance inkjet printing.

The substrates in the illustrated examples could be formed by any of several different materials such as various fibrous or film type sheets either or both of which could comprise one or more natural (e.g., cellulose, cotton, starch, and the like) and/or synthetic (e.g., polyethylene, polyester, polypropylene, and the like) materials. In one embodiment, a substrate comprises a non-woven cellulosic (e.g., paper) sheet.

The adhesives in the illustrated examples could include any type of adhesive, and may be applied wet, allowed to dry, and then heat-activated to become tacky. As examples, some common types of adhesives that could be used include water based acrylics, i.e., tacky acrylic resins dispersed in water, and hot-melt rubber based adhesives. In the water based acrylics, water is a carrier that dries to leave the adhesive resin. The hot-melt rubber based adhesives are applied in a molten form and then cooled, potentially to a solid.

Methods of applying adhesives include flood coating an entire surface of a substrate or selectively coating an area of the surface. Alternatively, the adhesives in the illustrated examples could comprise a dry film that is heat-activated to become tacky. The dry film may be applied to a surface of the substrate by a wet adhesive. An example of a the wet adhesive is a water based acrylic adhesive. Methods of applying the dry film include covering an entire surface of a substrate with the dry film or selectively covering an area of the surface. A heat seal layer may be included between the adhesive layers and the substrate. The heat seal layer can include a clay coating or a variety of resins. A heat seal layer can prevent heat applied to one surface of the substrate from being transferred to the opposing surface of the substrate.

The adhesives in the illustrated examples may be manipulated or modified in various ways to provide varying degrees of "tack", i.e., stickiness or strength of adherence, for the labels. As examples, the tack of an adhesive can be varied by modifying the adhesive's chemical composition, shape, size, and thickness. With some types of adhesives, the strength of adherence varies linearly with the amount of adhesive per area. For instance, where twice as much adhesive is used in a one area of a label compared with another area, the one area will have twice the strength of adherence of the other area. Additionally, the adhesive's tack can be varied by selectively activating different patterns on the adhesive.

Figure 10:
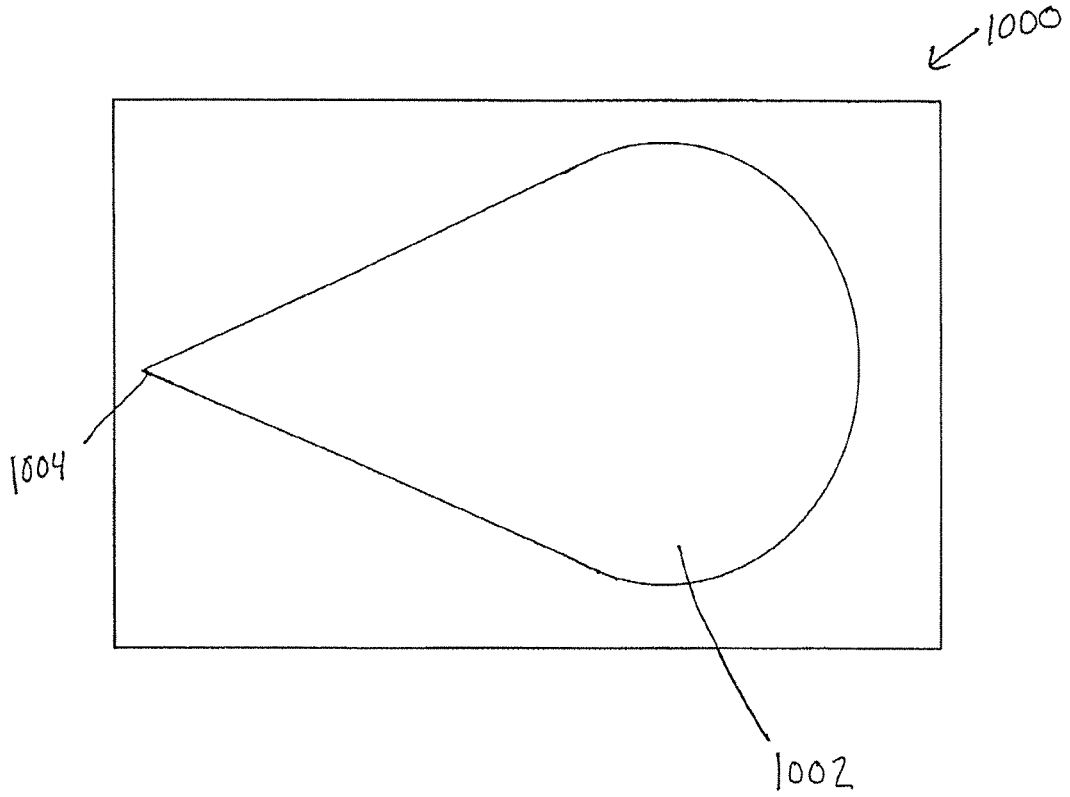
FIG. 10 is a view of a surface of a linerless label according to an embodiment.

As an example of selectively activating different patterns of adhesive material, FIG. 10 shows a heat-activated linerless label 1000 comprising an adhesive layer in which only a tear drop shape 1002 has been activated. The adhesive layer has less tack in a narrow portion 1004 of the teardrop shape 1002 so that label 1000 can be removed from a surface by pulling the label from the end near the narrow portion 1004.

Figure 11:
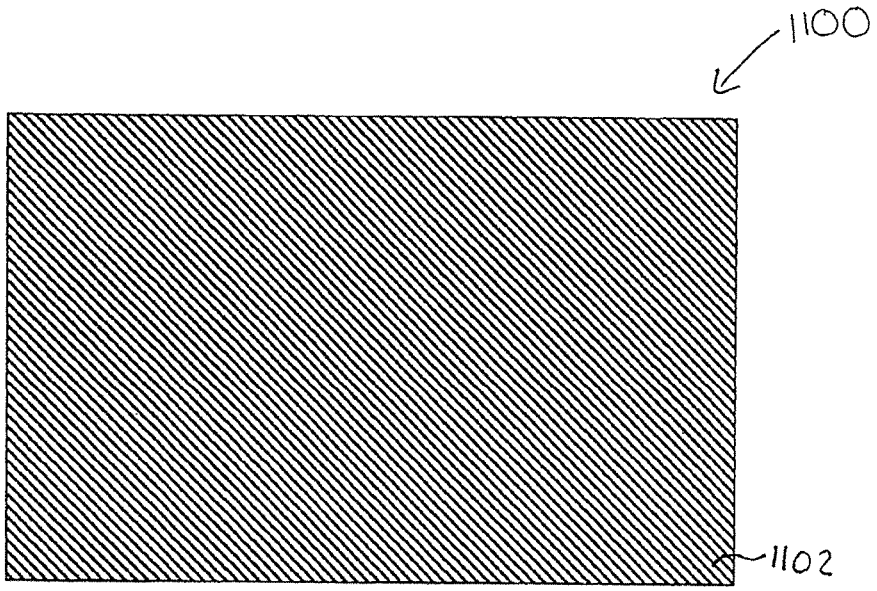
FIG. 11 is a view of a surface of a linerless label according to an embodiment.

As another example of selectively activating different patterns of adhesive material, FIG. 11 shows a heat activated linerless label 1100 comprising an adhesive layer 1102 in which a striped pattern is activated. This and other intricate patterns of activated adhesive can be formed on various labels because modern thermal print heads are capable of projecting heat in an accurate and specific way.

As yet another example of selectively activating different patterns of adhesive material, a thermal printer could selectively activate different distributions of "pixels" on the adhesive material. For example, assuming that a surface of the adhesive material is divided into a grid of evenly-spaced pixels, a thermal printer could selectively activate every other pixel or every third pixel so that the activated adhesive is relatively spread out. In this manner, the tack of the adhesive can be varied by controlling the number and spacing of pixels so activated. To illustrate selective activation of different adhesive pixels, FIG. 12 shows a surface of a heat-activated linerless label 1200 after selective pixels (represented by dots) of adhesive have been activated in a border region 1202. By controlling the density of activation (e.g., number of dots or pixels per unit area), and overall area of activation (e.g., size of the region 1202 relative to the substrate size) the tack of the resultant adhesive region, and overall strength of adhesion, may be controlled.

In some embodiments, printers used to print heat-activated linerless labels can include components formed from or coated with a nonstick material, such as polytetrafluoroethylene (PTFE), to prevent activated adhesive areas of the labels from sticking to the respective printer components. Such components may include, as examples, one or more thermal print heads, platens, guide rollers, drive mechanisms, cutters (e.g., knifes), and the like.

As discussed above, thermal print heads can be operated at specific temperatures. In view of this capability, labels can be formed with different types of adhesive that become activated at different temperatures. For instance, a label could be formed with a low tack heat-activated adhesive that becomes activated at a first temperature, and a high-tack adhesive that becomes activated at a second temperature each of which may be applied to a surface in a separate or a common adhesive laminate layer or coating. Such adhesives could include, for example, different acrylic polymers having different levels of tack and different activation temperatures.

Depending on the embodiment, heat-activated linerless labels can be provided in a roll that can be die-cut to produce individual labels from the roll. The blades of the die can be provided in any desired shape or size. Additionally, the blades of the die can include spaces such that the individual labels are perforated within the roll.

Figure 13:
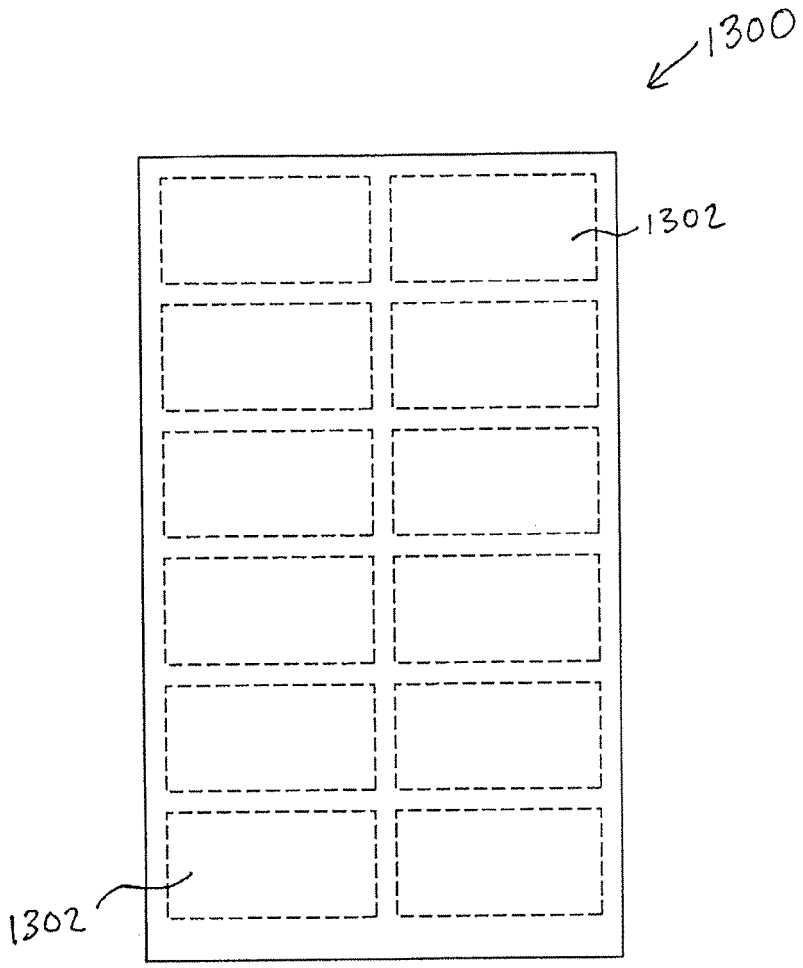
FIG. 13 is a view of a surface of a roll of linerless labels according to an embodiment prior to being rolled.

FIG. 13 illustrates a roll of heat-activated linerless label material 1300 prior to being wrapped into a roll. The label material 1300 includes die-cut perforations defining a perimeter of individual labels 1302.

Figure 14:
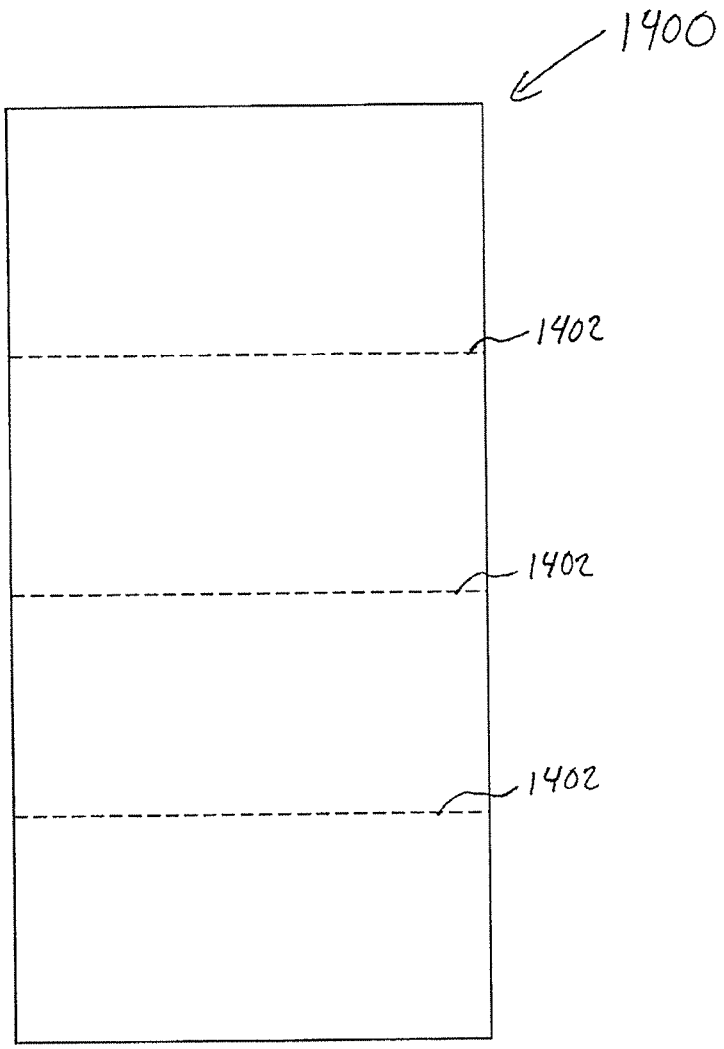
FIG. 14 is a view of a surface of a roll of linerless labels according to an embodiment prior to being rolled.

FIG. 14 illustrates another roll of heat-activated linerless label material 1400 prior to being wrapped into a roll. The label material 1400 includes linear perforations 1402. According to various embodiments, a roll of labels can be provided without perforations so that the user can cut each label by hand or by a serrated blade provided on the printer. Alternately, a printer may be provided with a mechanical knife to selectively cut label material to a desired size. In this manner, each label from a roll can be cut to a custom size.

Many specific details of certain embodiments of the invention are set forth in the description and in the Figures to provide a thorough understanding of these embodiments. A person skilled in the art, however, will understand that the invention may be practiced without several of these details or additional details can be added to the invention. Well-known structures and functions have not been shown or described in detail to avoid unnecessarily obscuring the description of the embodiments of the invention.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. Unless otherwise expressly noted, the word "or," in reference to a list of two or more items, covers all of the following interpretations of the word: any of the items in the list, all of the items in the list, and any combination of the items in the list.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize.

The terminology used in the Detailed Description is intended to be interpreted in its broadest reasonable manner, even though it is being used in conjunction with a detailed description of certain specific embodiments of the invention. Certain terms may even be emphasized; however, any terminology intended to be interpreted in any restricted manner will be overtly and specifically defined as such in this Detailed Description section. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

While certain aspects of the invention are presented below in certain claim forms, the inventors contemplate the various aspects of the invention in any number of claim forms. Accordingly, the inventors reserve the right to add additional claims after filing the application to pursue such additional claim forms for other aspects of the invention.

I claim:

1. A heat-activated label comprising:

a substrate including (i) a first major planar surface which faces a first direction and which has a first surface portion and a second surface portion which is different from the first surface portion and (ii) a second major planar surface which faces a second direction which is opposite the first direction;

a heat-activated adhesive formed directly on the first surface portion of the first major planar surface of the substrate;

a first thermal imaging material formed directly on the second surface portion of the first major planar surface of the substrate such that heat used to print the first thermal imaging material does not pass through the heat-activated adhesive; and a second thermal imaging material formed directly on the second major planar surface of the substrate;

wherein the substrate has a thermal resistance sufficient to (i) prevent heat applied to the second thermal imaging material from imaging the first thermal imaging material which is formed directly on the second surface portion of the first major planar surface of the substrate, (ii) prevent heat applied to the second thermal imaging material from activating the heat-activated adhesive which is formed directly on the first surface portion of the first major planar surface of the substrate, (iii) prevent heat applied to the first thermal imaging material from imaging the second thermal imaging material which is formed directly on the second major planar surface of the substrate and (iv) prevent heat applied to the heat-activated adhesive from imaging the second thermal imaging material which is formed directly on the second major planar surface of the substrate.

2. The heat-activated label of claim 1, wherein the first thermal imaging material formed directly on the second surface portion of the first major planar surface of the substrate has a first imaging temperature and the second thermal imaging material formed directly on the second major planar surface of the substrate has a second imaging temperature different from the first imaging temperature.

3. A method of preparing a heat-activated label comprising a substrate including (i) a first major planar surface which faces a first direction and which has a first surface portion and a second surface portion which is different from the first surface portion and (ii) a second major planar surface which faces a second direction which is opposite the first direction, a heat-activated adhesive formed directly on the first surface portion of the first major planar surface of the substrate, a first thermal imaging material formed directly on the second surface portion of the first major planar surface of the substrate, and a second thermal imaging material formed directly on the second major planar surface of the substrate, the method comprising:

selectively applying heat to the heat-activated adhesive using a thermal print head to selectively activate the heat-activated adhesive;

selectively applying heat to the first thermal imaging material using a thermal print head to print a first visible pattern such that heat applied to the first thermal imaging material does not pass through the heat-activated adhesive; and selectively applying heat to the second thermal imaging material using a thermal print head to print a second visible pattern which is different from the first visible pattern.

4. The method of claim 3, wherein (i) one the first and second thermal imaging materials comprises a thermal transfer receptive coating and (ii) the other one of the first and second thermal imaging materials comprises a thermally sensitive coating.

5. The method of claim 3, wherein the heat-activated adhesive and the first thermal imaging material are respectively activated and imaged at substantially the same time.

6. The method of claim 3, further comprising:

before activating the heat-activated adhesive, determining a desired strength of adhesion for the label; and activating a portion of the heat-activated adhesive in a pattern designed to achieve the desired strength of adhesion.

7. The method of claim 3, wherein (i) the heat-activated adhesive covers a first area of the first surface portion of the first major planar surface of the substrate and (ii) the selectively activated portion of the heat-activated adhesive covers a second area of the first surface portion of the first major planar surface of the substrate smaller than the first area.

* * * * *